US007455543B2

(12) United States Patent
Natter et al.

(10) Patent No.: US 7,455,543 B2
(45) Date of Patent: Nov. 25, 2008

(54) ELECTRIC PLUG CONNECTOR WITH BAYONET RING AND SECONDARY LOCK

(75) Inventors: Brantley Natter, Brighton, MI (US); Peter Epe, Lennestadt (DE)

(73) Assignee: Kostal Kontakt Systeme GmbH, Ludenscheid (DE)

( * ) Notice: Subject to any disclaimer, the term of this patent is extended or adjusted under 35 U.S.C. 154(b) by 0 days.

(21) Appl. No.: 12/069,222

(22) Filed: Feb. 8, 2008

(65) Prior Publication Data

US 2008/0200076 A1 Aug. 21, 2008

Related U.S. Application Data

(63) Continuation of application No. PCT/EP2006/007969, filed on Aug. 11, 2006.

(30) Foreign Application Priority Data

Aug. 12, 2005 (DE) ..... 10 2005 038 167

(51) Int. Cl.
*H01R 13/62* (2006.01)

(52) U.S. Cl. ..... 439/318; 285/85

(58) Field of Classification Search ..... 439/318, 439/321; 285/81–85, 91, 361
See application file for complete search history.

(56) References Cited

U.S. PATENT DOCUMENTS

| | | | | |
|---|---|---|---|---|
| 836,457 | A * | 11/1906 | Peller | 285/85 |
| 2,165,163 | A * | 7/1939 | Waters | 285/91 |
| 3,083,274 | A | 3/1963 | Sparkes | |
| 5,984,709 | A | 11/1999 | Zink et al. | |
| 6,206,714 | B1 | 3/2001 | Bernardini | |
| 6,386,897 | B1 | 5/2002 | Muller | |
| 6,398,136 | B1 * | 6/2002 | Smith | 239/600 |
| 6,422,903 | B1 | 7/2002 | Fekonja et al. | |
| 7,077,677 | B2 * | 7/2006 | Sanuki | 439/318 |

FOREIGN PATENT DOCUMENTS

| | | |
|---|---|---|
| DE | 32 48 154 C1 | 4/1984 |
| DE | 196 52 838 A1 | 7/1998 |
| DE | 198 30 671 A1 | 1/2000 |
| DE | 198 30 672 A1 | 1/2000 |
| DE | 199 16 075 C1 | 2/2001 |

* cited by examiner

*Primary Examiner*—Neil Abrams
(74) *Attorney, Agent, or Firm*—Brooks Kushman P.C.

(57) ABSTRACT

An electric plug connector includes a guide sleeve, a plug connector part attachable to the guide sleeve, a bayonet ring on the connector part for rotatably engaging with the guide sleeve to move between unlocked and locked positions, and a locking button arranged on the bayonet ring to slide with the ring as the ring moves. While the connector part is attached to the guide sleeve the ring locks the attachment by engaging with the guide sleeve when the ring is in its locked position. The button is displaceable relative to the guide sleeve between inactivated and activated positions. The button includes a latching hook and a pin that interact with the sleeve to enable the button to move between its inactivated and activated positions. The latching hook and the pin engage with the sleeve when the button is in its activated position to secure the locking of the attachment with the end of the pin engaged in a receptacle formed on the surface of the sleeve to prevent rotation of the bayonet ring.

20 Claims, 2 Drawing Sheets

ELECTRIC PLUG CONNECTOR WITH BAYONET RING AND SECONDARY LOCK

CROSS-REFERENCE TO RELATED APPLICATIONS

This is a continuation of International Application PCT/EP2006/007969, published in German, with an international filing date of Aug. 11, 2006, which claims priority to DE 10 2005 038 167.7, filed Aug. 12, 2005, the disclosures of which are both hereby incorporated by reference.

BACKGROUND OF THE INVENTION

1. Field of the Invention

The present invention relates to an electric plug connector having a plug connector part attached to a guide sleeve in which a bayonet ring of the plug connector part locks the attachment.

2. Background Art

DE 198 30 672 A1 (corresponding to U.S. Pat. No. 6,394,814, which is hereby incorporated by reference) describes an electric plug connector having two plug connector parts for connecting a vehicle transmission control system. For this purpose, a plug housing is designed as a lockable plug connector part.

A bayonet ring (i.e., bayonet socket) may be used as a primary lock to lock an attachment between two plug connector parts or between a plug connector part and a guide sleeve. A general requirement within the automobile industry is that a secondary lock be used to protect the attachment from separating. In the case of two plug connector parts linearly inserted into one another and latched, a bolt insertable along or opposite to the insertion direction usually serves as the secondary lock. While in a locking position, the bolt blocks the locking element forming the location of the primary lock.

SUMMARY OF THE INVENTION

An object of the present invention includes an electric plug connector having a plug connector part and a guide sleeve in which a bayonet ring of the connector part is used as a primary lock to lock an attachment between the connector part and the guide sleeve and a simple and economical secondary lock secures the locking of the bayonet ring to protect the attachment from separating.

In carrying out the above object and other objects, the present invention provides an electric plug connector having a guide sleeve, a plug connector part having a bayonet ring, and a locking button. The connector part has a housing containing contact elements and is attachable to the guide sleeve. The bayonet ring is on the connector part for rotatably engaging with the guide sleeve to spirally move between initial and final positions. While the connector part is attached to the guide sleeve the bayonet ring locks the attachment by engaging with the outer surface of the guide sleeve when the bayonet ring is in its final position. The locking button is arranged on the bayonet ring to slide with the bayonet ring relative to the guide sleeve as the bayonet ring moves between its initial and final positions. The locking button is displaceable relative to the outer surface of the guide sleeve between an initial position and a final position. The locking button includes a latching hook and at least one pin that interact with the outer surface of the guide sleeve to enable the locking button to move between its initial and final positions. The latching hook and the pin engage with the outer surface of the guide sleeve when the locking button is in its final position. While the bayonet ring locks the attachment between the connector part and the guide sleeve the locking button secures the locking of the attachment when the locking button is in its final position.

Further, in carrying out the above object and other objects, the present invention provides an electric plug connector having a guide sleeve, a connector part attachable to the guide sleeve, a bayonet ring on the connector part for rotatably engaging with the guide sleeve to move between unlocked and locked positions, and a locking button arranged on the bayonet ring to slide with the bayonet ring as the bayonet ring moves relative to the guide sleeve. While the connector part is attached to the guide sleeve the bayonet ring locks the attachment by engaging with the guide sleeve when the bayonet ring is in its locked position. The locking button is displaceable relative to the guide sleeve between inactivated and activated positions. The locking button includes a latching hook and a pin that interact with the guide sleeve to enable the locking button to move between its inactivated and activated positions. The latching hook and the pin engage with the guide sleeve when the locking button is in its activated position to secure the locking of the attachment.

The guide sleeve may include a pocket-shaped receptacle. In this case, the pin engages the pocket-shaped receptacle of the guide sleeve when the locking button is in its activated position. The latching hook of the locking button may include a front detent and a middle detent, the bayonet ring may include an edge, and the guide sleeve may further include a front edge and an elevated edge. In this case, the bayonet ring prevents the locking button from moving from its inactivated position to its activated position when the bayonet ring is in its unlocked position as the edge of the bayonet ring engages the middle detent of the latching hook and the front detent of the latching hook rests on the front edge of the guide sleeve. The guide sleeve and the bayonet ring enable the locking button to move from its inactivated position to its activated position when the bayonet ring is in its locked position as the front detent of the latching hook is elevated by the elevated edge of the guide sleeve such that the edge of the bayonet ring is disengaged from the middle detent of the latching hook. The guide sleeve and the bayonet ring prevent the locking button from moving from its inactivated position to its activated position after the locking button has been moved to its locked position as the front detent of the latching hook latches onto the elevated edge of the guide sleeve and the middle detent of the latching hook engages the edge of the bayonet ring to form a double detent connection between the locking button, the bayonet ring, and the guide sleeve.

In an embodiment, an electric plug connector includes a plug connector part attached to a guide sleeve. A bayonet ring of the plug connector part functions as a primary lock for locking the attachment. The bayonet ring is spirally movable around the guide sleeve between an initial latching position and a final latching position (i.e., final locking position). In its final latching position, the bayonet ring locks the attachment. A locking push button on the bayonet ring functions as a secondary lock for securing the locking of the bayonet ring to protect the attachment from separating. The locking button is movable toward the guide sleeve from an initial latching position into a final latching position (i.e., final locking position). In its final latching position, the locking button secures the locking of the bayonet ring. The locking button is also movable (with an appropriate amount of force) in the reverse direction away from the guide sleeve from its final latching position to its initial latching position. In its initial latching position, the locking button is released from securing the locking of the bayonet ring while the bayonet ring is in its final latching position.

The locking button includes at least one pin. The pin slides toward the guide sleeve as the locking button moves from its initial latching position to its final latching position. The pin interacts with an outer surface profile of the guide sleeve to enable the locking button to move between its initial and final latching positions. The locking button and the guide sleeve are operable with one another such that the locking button can move into its final latching position only when the bayonet ring is in its final latching position.

When the locking button is in its final latching position the primary lock formed by the bayonet ring cannot be released. The locking button has to be pulled outward with an appropriate amount of force in order to move from its final latching position to its initial latching position (i.e., pre-locking position) to release the primary lock.

An observer may discern that the bayonet ring is in its final latching position from observing that the locking button is in its final latching position. As such, an inadvertent incomplete primary lock can be avoided.

The above features, other features, and advantages of the present invention are readily apparent from the following detailed descriptions thereof when taken in connection with the accompanying drawings.

DETAILED DESCRIPTION OF THE PREFERRED EMBODIMENT(S)

Figure 1:
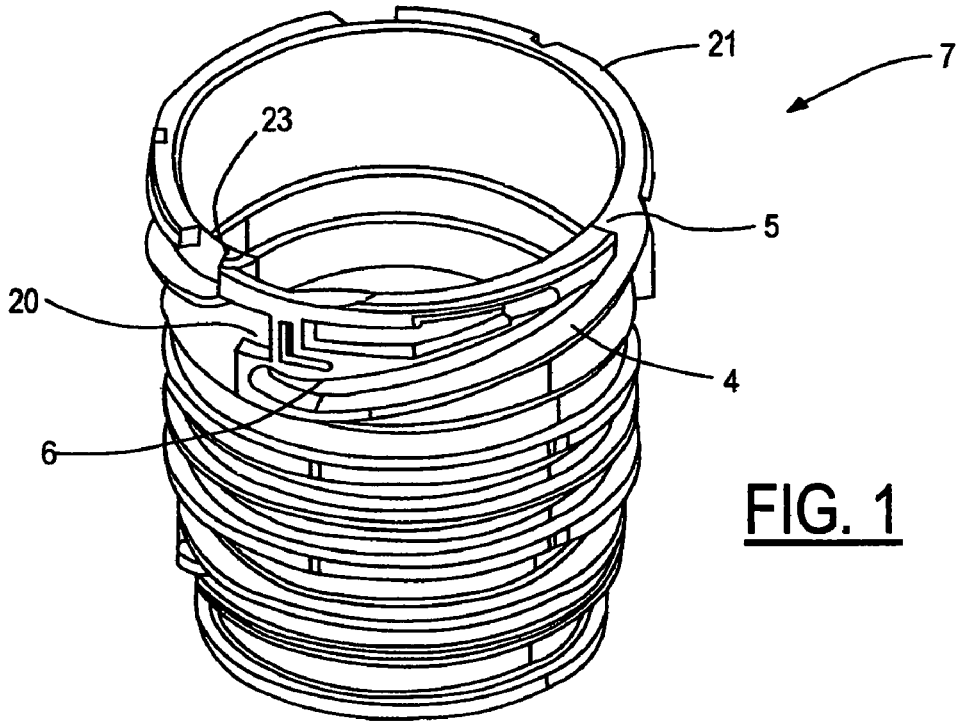
FIG. 1 illustrates an embodiment of a guide sleeve of an electric plug connector in accordance with an embodiment of the present invention.

Referring now to FIG. 1, a guide sleeve 7 of an electric plug connector in accordance with an embodiment of the present invention is shown. The electric plug connector includes a first plug connector part 1 (shown in FIGS. 3*a*, 3*b*, 3*c*) and a second plug connector part. The plug connector parts are attachable to one another via guide sleeve 7. In a mounted state, the electric plug connector includes the plug connector parts attached to one another via guide sleeve 7.

In particular, first plug connector part 1 is attachable to the upper end section of guide sleeve 7 and the second plug connector part is attachable to the lower end section of guide sleeve 7. First plug connector part 1 is attached to the upper end section of guide sleeve 7 via a bayonet lock. The second plug connector part is attached to the lower end section of guide sleeve 7 in the same manner or in a different manner such as by a screw or latching connection or is combined as a single piece with the lower end section of guide sleeve 7.

Guide sleeve 7 has a hollow cylinder shape and includes a recessed surface profile on its outer surface. A spiral longitudinal slot 4 is formed along the outer side of the upper end section of guide sleeve 7. Spiral slot 4 runs on the upper end section of guide sleeve 7 up to a front edge 21 of guide sleeve 7. Spiral slot 4 ends at front edge 21 of guide sleeve 7 in recesses which form a transverse slot 5.

Figure 3:
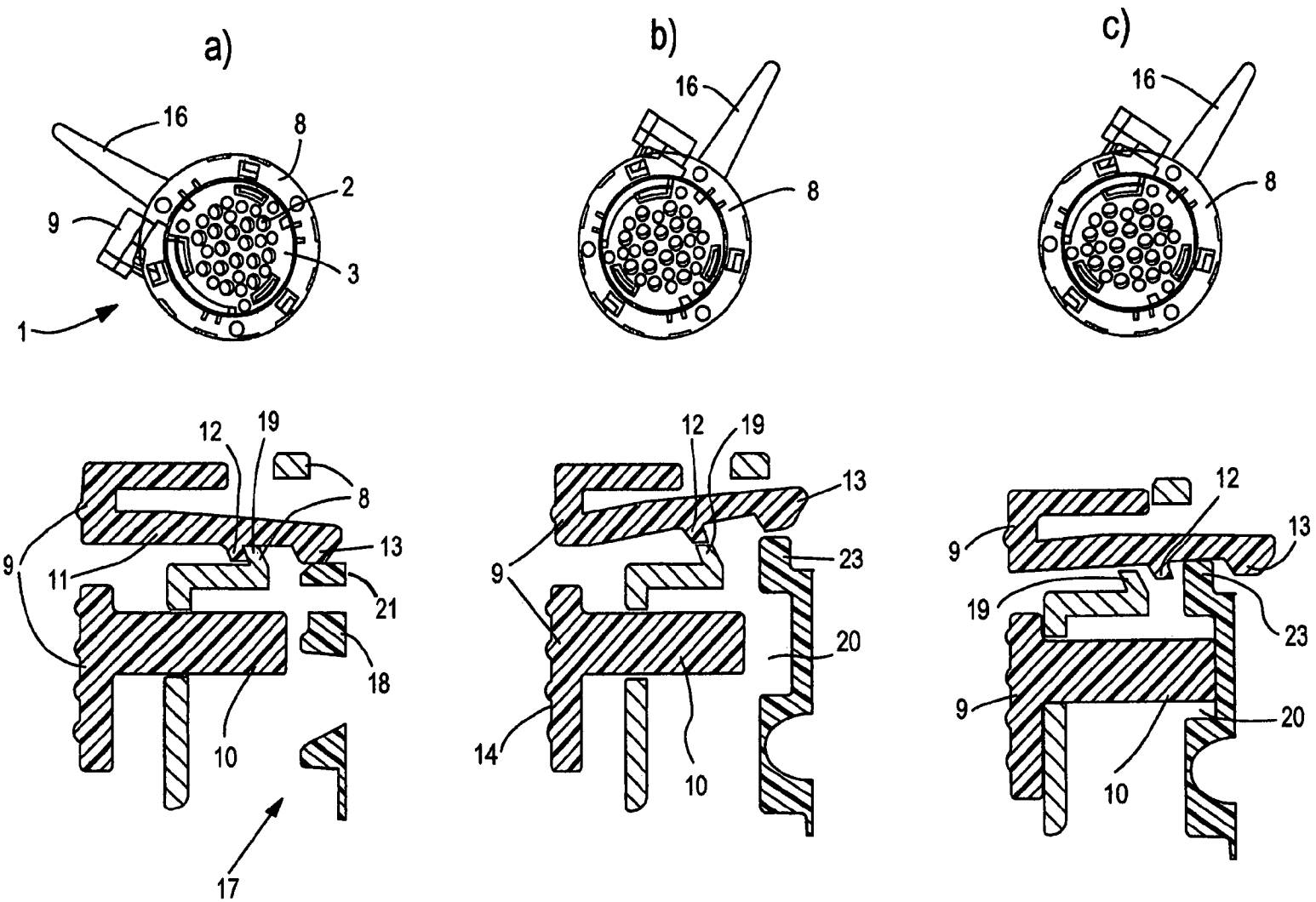
FIG. 3*a* illustrates a top view and a cross-sectional view of the interaction of a bayonet ring of a plug connector part of the electric plug connector and the locking button with the guide sleeve in which both the bayonet ring and the locking button are in their initial latching positions.
FIG. 3*b* illustrates a top view and a cross-sectional view of the interaction of the bayonet ring and the locking button with the guide sleeve in which the bayonet ring is in its final latching position and the locking button is in a position between its initial and final latching positions.
FIG. 3*c* illustrates a top view and a cross-sectional view of the interaction of the bayonet ring and the locking button with the guide sleeve in which both the bayonet ring and the locking button are in their final latching positions.

First plug connector part 1 includes a bayonet ring 8 (shown in FIGS. 3*a*, 3*b*, 3*c*). Bayonet ring 8 is used as a primary lock to lock the attachment of first plug connector part 1 to the upper end section of guide sleeve 7. Bayonet ring 8 is spirally movable around guide sleeve 7 between an initial latching position (shown in FIG. 3*a*) and a final latching position (shown in FIGS. 3*b* and 3*c*). In particular, bayonet ring 8 is spirally movable around guide sleeve 7 by rotating around guide sleeve 7 along transverse slot 5 and spiral slot 4. When first plug connector part 1 is attached to guide sleeve 7, pin-shaped indentations are formed in transverse slot 5 on bayonet ring 8 and guided by turning bayonet ring 8 along spiral slot 4. In its final latching position, bayonet ring 8 locks the attachment between first plug connector part 1 and guide sleeve 7.

Bayonet ring 8 includes a collar overlapping guide sleeve 7 (shown in FIGS. 3*a*, 3*b*, 3*c*). The collar holds the pin-shaped indentations on its inner side. The pin-shaped indentations extend into spiral slot 4. Spiral slot 4 includes a latching edge 6 in the region of its lower end section. Latching edge 6 represents the stopping point of spiral slot 4 and thereby defines the final latching position of bayonet ring 8. As such, latching edge 6 enables the detection of bayonet ring 8 reaching its final latching position during the locking process as bayonet ring 8 rotates around guide sleeve 7.

The interaction between bayonet ring 8 and latching edge 6 along with contact forces of electric connection elements of first plug connector part 1 provide a mechanical security between first plug connector part 1 and guide sleeve 7. In particular, bayonet ring 8 serves as a primary lock for locking the attachment between first plug connector part 1 and guide sleeve 7. As first plug connector part 1 and guide sleeve 7 are thereby only held together by a force-fit, it is possible that this attachment could loosen under unfavorable circumstances. Such circumstances include the electric plug connector being subjected to vibrational loading in a vehicle engine compartment.

Figure 2:
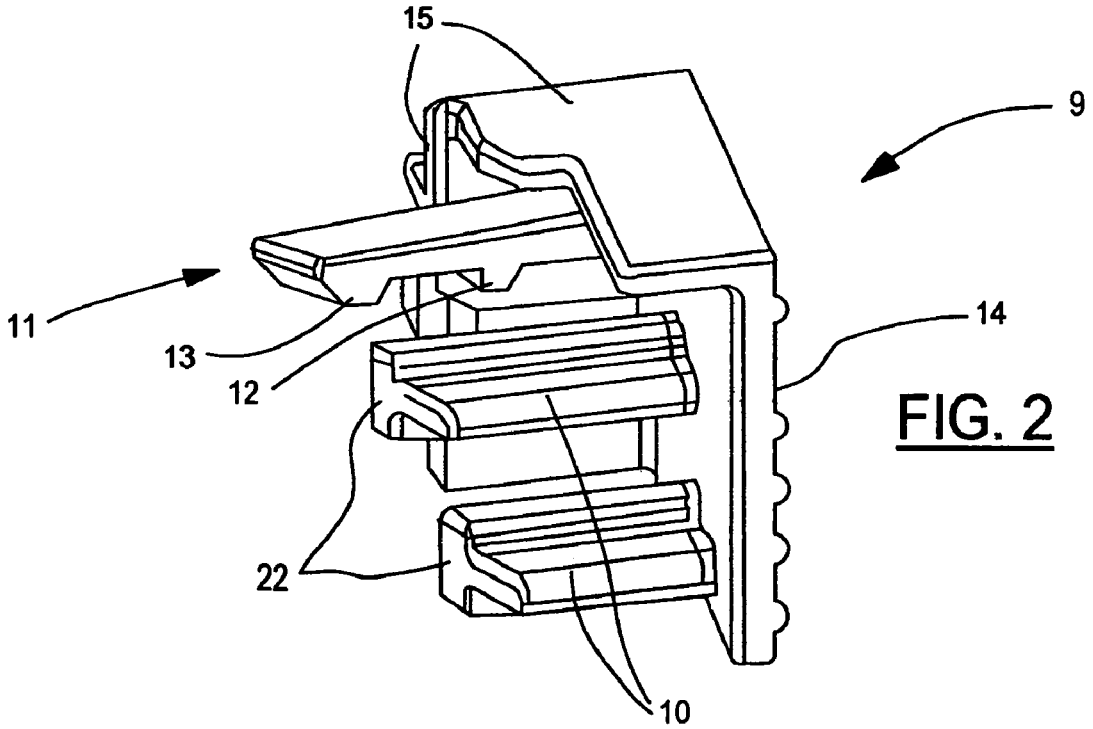
FIG. 2 illustrates an embodiment of a locking button of the electric plug connector.

Referring now to FIG. 2, a locking push button 9 of the electric plug connector is shown. Locking button 9 functions as a secondary lock for securing the locking of bayonet ring 8 to protect the attachment between first plug connector part 1 and guide sleeve 7 from separating. Locking button 9 represents a simple and economical secondary lock which secures the primary locking of bayonet ring 8 to prevent the attachment from separating. To this end, locking button 9 is arranged to slide on the outer side of bayonet ring 8. Locking button 9 is movable toward guide sleeve 7 from an initial latching position (i.e., pre-locking position) to a final latching position. In its final latching position, locking button 9 secures the locking of bayonet ring 8. Locking button 9 is also movable (with an appropriate amount of force) in the reverse direction away from guide sleeve 7 from its final latching position to its initial latching position. In its initial latching position, locking button 9 is released from securing the locking of bayonet ring 8 while bayonet ring 8 is in its final latching position.

Locking button 9 and guide sleeve 7 are operable with one another such that locking button 9 can move into its final latching position only when bayonet ring 8 is in its final latching position. When locking button 9 is in its final latching position the primary lock formed by bayonet ring 8 cannot be released. Locking button 9 has to be pulled outward with an appropriate amount of force to move from its final latching position to its initial latching position to release the primary lock. An observer may discern that bayonet ring 8 is in its final latching position from observing that locking button 9 is in its final latching position.

Locking button 9 includes an actuating plate 14 and two side walls 15. Side walls 15 extend perpendicular from the inner surface of actuating plate 14. Actuating plate 14 and side walls 15 are designed so that locking button 9 can rest optimally on the outer side of bayonet ring 8. Locking button 9 further includes a latching hook 11 and two pins 10 formed on the inner side of locking button 9 and extending perpendicular from the inner surface of actuating plate 14. Latching hook 11 includes a middle detent 12 and a front detent 13. As described in further detail with respect to FIGS. 3*a*, 3*b*, and 3*c*, pins 10 and latching hook 11 slide toward the outer surface profile of guide sleeve 7 as locking button 9 is moved from its initial latching position to its final latching position. Latching hook 11 and pins 10 interact with the outer surface profile of guide sleeve 7 to enable locking button 9 to move between its initial and final latching positions.

Referring now to FIGS. 3*a*, 3*b*, and 3*c*, top and cross-sectional views of the interaction of bayonet ring 8 and locking button 9 with guide sleeve 7 are shown. FIG. 3*a* illustrates a top view and a cross-sectional view of the interaction of bayonet ring 8 and locking button 9 with guide sleeve 7 in which both bayonet ring 8 and locking button 9 are in their initial latching positions. FIG. 3*b* illustrates a top view and a cross-sectional view of the interaction of bayonet ring 8 and locking button 9 with guide sleeve 7 in which bayonet ring 8 is in its final latching position and locking button 9 is in a position between its initial and final latching positions. FIG. 3*c* illustrates a top view and a cross-sectional view of the interaction of bayonet ring 8 and locking button 9 with guide sleeve 7 in which both bayonet ring 8 and locking button 9 are in their final latching positions. As such, bayonet ring 8 is in an unlocked position with respect to guide sleeve 7 in FIG. 3*a* and is in a locked position with respect to guide sleeve 7 in FIGS. 3*b* and 3*c*. Likewise, locking button 9 is not activated in FIGS. 3*a* and 3*b* and is activated in FIG. 3*c*.

As shown in the top views of FIGS. 3*a*, 3*b*, and 3*c*, a socket housing 3 is located within the interior of bayonet ring 8 and is connected to bayonet ring 8. Socket housing 3 accepts electric contact elements 2 which can have wire leads. Socket housing 3 and bayonet ring 8 together form first plug connector part 1. Although not shown, the second plug connector part includes a socket housing which accepts complementary electric contact elements.

Bayonet ring 8 has a surrounding collar extending over the outer side of guide sleeve 7. Socket housing 3 is recessed into the opening of guide sleeve 7. When bayonet ring 8 is rotated relative to guide sleeve 7 while connected to guide sleeve 7, bayonet ring 8 is displaced along the spiral bayonet guide (i.e., spiral slot 4) of guide sleeve 7. As a result of this, socket housing 3 is inserted further into guide sleeve 7 such that contact elements 2 come into contact with the complementary contact elements of the second plug connector part, which is attached to the lower end section of guide sleeve 7. U.S. Pat. No. 6,394,814, which is incorporated by reference herein, describes such a second plug connector part of the electric plug connector.

Locking button 9 is arranged to slide on the outer side of bayonet ring 8 such that pins 10 and latching hook 11 can be displaced in the direction of guide sleeve 7. The direction of the displacement of pins 10 and latching hook 11 is at an angle of roughly 45° relative to the radial direction. This displacement direction forms a compromise between a radial displacement direction, which permits too small an activation path, and a tangential displacement direction, which makes force-fit latching problematic from a manufacturing point of view.

The free end sections of pins 10 are slanted surfaces 22 with respect to the plane of actuating plate 14 passing parallel to the tangential plane at the point of contact between pins 10 and the surface of guide sleeve 7. This results in a maximal contact surface between pins 10 and guide sleeve 7.

The cross-sectional views of FIGS. 3*a*, 3*b*, and 3*c* each illustrate a cross-sectional diagram through locking button 9 wherein the respective positions of locking button 9 relative to bayonet ring 8 and surface profile 17 of guide sleeve 7 are shown.

In the position shown in FIG. 3*a*, bayonet ring 8 has just been inserted into the bayonet guide. As such, bayonet ring 8 is in an unlocked position. Front detent 13 of latching hook 11 lies on a relatively flat section of front edge 21 of guide sleeve 7. In this manner, middle detent 12 of latching hook 11 moves up against an edge 19 formed on bayonet ring 8 whereby locking button 9 cannot be displaced in the direction of guide sleeve 7. A section 18 of surface profile 17 of guide sleeve 7 is formed by a section of the convex edge of spiral slot 4 on guide sleeve 7. Section 18 also prevents a displacement of locking button 9 in the direction of guide sleeve 7. Locking button 9 is thereby initially fixed immovably in its starting position.

In the position shown in FIG. 3*b*, bayonet ring 8 is locked in its final latching position in the bayonet guide after being rotated by 90° in the clockwise direction. The position of bayonet ring 8 relative to guide sleeve 7 is detectable from the change in position of rotating lever 16. Lever 16 serves as an actuation aid for amplifying the force when latching the bayonet lock. Front detent 13 of latching hook 11 now moves up against an elevated section 23 of front edge 21 of guide sleeve 7. In particular, elevated section 23 of front edge 21 of guide sleeve 7 forces front detent 13 of latching hook 11 upward. This causes latching hook 11 to become fully lifted so that middle detent 12 is also lifted above the level of edge 19 whereby locking button 9 is freely displaceable in the direction of guide sleeve 7.

Pressure on activation plate 14 directed toward guide sleeve 7 causes locking button 9 to be displaced in the direction of guide sleeve 7 whereby the inner side of activation plate 14 moves up against the outer wall of bayonet ring 8. A correct setting of the secondary lock by locking button 9 can thereby be detected at a glance along with the previously successful error-free primary connection of first plug connector part 1.

In the position shown in FIG. 3*c*, locking button 9 is in its final latching position. In this case, pins 10 on locking button 9 engage in a pocket-shaped receptacle 20 formed on the surface profile of guide sleeve 7. This causes bayonet ring 8 to be locked relative to guide sleeve 7. Pocket-shaped receptacle 20 is also indicated in FIG. 1 for clarity along with elevated section 23 of front edge 21 of guide sleeve 7.

As shown in FIG. 3*c*, locking button 9 is secured by a double detent connection. This double detent connection is formed by edge 19 on bayonet ring 8 and middle detent 12 on latching hook 11 of locking button 9 and by elevated section 23 on guide sleeve 7 and front detent 13, whereby an unintentional release of the secondary lock is prevented. The secondary lock can be released only by pulling back strongly on locking button 9 against the double latching connection.

Only after doing this can the clamped first and second plug connector parts be separated from one another.

Reference List

1 First plug connector part
2 Contact elements
3 First housing (socket housing)
4 Spiral longitudinal slot (bayonet guide)
5 Transverse slot
6 Latching edge
7 Guide sleeve
8 Bayonet ring
9 Locking button
10 Pins
11 Latching hook
12 Middle detent
13 Front detent
14 Actuating plate
15 Side walls
16 Rotating lever
17 Surface profile
18 Section of the surface profile
19 Edge
20 Pocket-shaped receptacle
21 Front edge
22 Slanted surfaces
23 Elevated section of the front edge While embodiments of the present invention have been illustrated and described, it is not intended that these embodiments illustrate and describe all possible forms of the present invention. Rather, the words used in the specification are words of description rather than limitation, and it is understood that various changes may be made without departing from the spirit and scope of the present invention.

What is claimed is:

1. An electric plug connector comprising:

a guide sleeve having an outer surface;

a connector part having a housing containing contact elements, wherein the connector part is attachable to the guide sleeve;

a bayonet ring on the connector part for rotatably engaging with the guide sleeve to spirally move between an initial position and a final position, wherein while the connector part is attached to the guide sleeve the bayonet ring locks the attachment between the connector part and the guide sleeve by engaging with the outer surface of the guide sleeve when the bayonet ring is in its final position; and a locking button arranged on the bayonet ring to slide with the bayonet ring relative to the guide sleeve as the bayonet ring moves between its initial and final positions, wherein the locking button is displaceable relative to the outer surface of the guide sleeve between an initial position and a final position, wherein the locking button includes a latching hook and at least one pin that interact with the outer surface of the guide sleeve to enable the locking button to move between its initial and final positions, wherein the latching hook and the pin engage with the outer surface of the guide sleeve when the locking button is in its final position, wherein while the bayonet ring locks the attachment between the connector part and the guide sleeve the locking button secures the locking of the attachment when the locking button is in its final position.

2. The plug connector of claim 1 wherein:

the guide sleeve has an upper end section and a lower end section, wherein the connector part is attachable to the upper end section of the guide sleeve and a second connector part is attachable to the lower end section of the guide sleeve such that the connector parts are attached via the guide sleeve when the connector parts are attached to the guide sleeve.

3. The plug connector of claim 1 wherein:

the lower end section of the guide sleeve is connected integrally with the second connector part.

4. The plug connector of claim 1 wherein:

the locking button includes a plurality of pins.

5. The plug connector of claim 4 wherein:

the pins are formed integrally on the locking button.

6. The plug connector of claim 1 wherein:

the outer surface of the guide sleeve includes a pocket-shaped receptacle, wherein the pin engages the pocket-shaped receptacle of the outer surface of the guide sleeve when the locking button is in its final locking position.

7. The plug connector of claim 6 wherein:

the pin has an end, wherein the pin end engages the pocket-shaped receptacle of the outer surface of the guide sleeve, wherein the pin end is slanted relative to the tangential direction of the guide sleeve at the point of engagement of the pin end and the pocket-shaped receptacle.

8. The plug connector of claim 1 wherein:

the latching hook of the locking button includes a front detent and a middle detent, the bayonet ring includes an edge, and the outer surface of the guide sleeve includes a front edge and an elevated edge.

9. The plug connector of claim 8 wherein:

when the bayonet ring and the locking button are in their initial positions, the edge of the bayonet ring engages the middle detent of the latching hook to prevent the locking button from moving from its initial position to its final position and the front detent of the latching hook rests on the front edge of the outer surface of the guide sleeve.

10. The plug connector of claim 9 wherein:

the bayonet ring prevents the locking button from moving from its initial position to its final position when the bayonet ring is in its initial position.

11. The plug connector of claim 9 wherein:

when the bayonet ring is in its final position, the front detent of the latching hook is elevated by the elevated edge of the outer surface of the guide sleeve such that the edge of the bayonet ring disengages the middle detent of the latching hook to enable the locking button to move from its initial position to its final position.

12. The plug connector of claim 11 wherein:

the outer surface of the guide sleeve and the bayonet ring enable the locking button to move from its initial position to its final position when the bayonet ring is in its final position.

13. The plug connector of claim 11 wherein:

when the bayonet ring and the locking button are in their final positions, the front detent of the latching hook latches onto the elevated edge of the outer surface of the guide sleeve and the middle detent of the latching hook engages the edge of the bayonet ring to form a double detent connection between the locking button, the bayonet ring, and the guide sleeve.

14. The plug connector of claim 13 wherein:

the outer surface of the guide sleeve and the bayonet ring prevent the locking button from moving from its final position to its initial position after the locking button has been moved to its final position.

15. An electric plug connector comprising:

a guide sleeve;

a connector part attachable to the guide sleeve;

a bayonet ring on the connector part for rotatably engaging with the guide sleeve to move between unlocked and locked positions, wherein while the connector part is attached to the guide sleeve the bayonet ring locks the attachment by engaging with the guide sleeve when the bayonet ring is in its locked position; and a locking button arranged on the bayonet ring to slide with the bayonet ring as the bayonet ring moves relative to the guide sleeve, wherein the locking button is displaceable relative to the guide sleeve between inactivated and activated positions, wherein the locking button includes a latching hook and a pin that interact with the guide sleeve to enable the locking button to move between its inactivated and activated positions, wherein the latching hook and the pin engage with the guide sleeve when the locking button is in its activated position to secure the locking of the attachment.

16. The plug connector of claim 15 wherein:

the guide sleeve includes a pocket-shaped receptacle, wherein the pin engages the pocket-shaped receptacle of the guide sleeve when the locking button is in its activated position.

17. The plug connector of claim 16 wherein:

the latching hook of the locking button includes a front detent and a middle detent, the bayonet ring includes an edge, and the guide sleeve further includes a front edge and an elevated edge.

18. The plug connector of claim 17 wherein:

the bayonet ring prevents the locking button from moving from its inactivated position to its activated position when the bayonet ring is in its unlocked position as the edge of the bayonet ring engages the middle detent of the latching hook and the front detent of the latching hook rests on the front edge of the guide sleeve.

19. The plug connector of claim 18 wherein:

the guide sleeve and the bayonet ring enable the locking button to move from its inactivated position to its activated position when the bayonet ring is in its locked position as the front detent of the latching hook is elevated by the elevated edge of the guide sleeve such that the edge of the bayonet ring is disengaged from the middle detent of the latching hook.

20. The plug connector of claim 19 wherein:

the guide sleeve and the bayonet ring prevent the locking button from moving from its inactivated position to its activated position after the locking button has been moved to its locked position as the front detent of the latching hook latches onto the elevated edge of the guide sleeve and the middle detent of the latching hook engages the edge of the bayonet ring to form a double detent connection between the locking button, the bayonet ring, and the guide sleeve.

* * * * *